United States Patent [19]

Yohe

[11] Patent Number: 4,913,877

[45] Date of Patent: Apr. 3, 1990

[54] SURFACE MODIFIED CEMENTED CARBIDES

[75] Inventor: Warren C. Yohe, Troy, Mich.

[73] Assignee: GTE Valenite Corporation, Troy, Mich.

[21] Appl. No.: 293,044

[22] Filed: Jan. 3, 1989

Related U.S. Application Data

[63] Continuation of Ser. No. 129,565, Dec. 7, 1987, Pat. No. 4,828,612.

[51] Int. Cl.[4] ..... G22F 1/00

[52] U.S. Cl. ..... 419/13; 419/16; 419/32; 75/238; 75/242; 75/244

[58] Field of Search ..... 75/244, 238, 242; 419/8, 9, 45, 32, 16

[56] References Cited

U.S. PATENT DOCUMENTS

| | | | |
|---|---|---|---|
| 3,409,416 | 11/1968 | Yates | 29/182.5 |
| 3,409,419 | 11/1968 | Yates | 29/182.5 |
| 3,507,631 | 4/1970 | Yates | 29/182.7 |
| 3,669,695 | 6/1972 | Iler et al. | 106/43 |
| 4,277,283 | 7/1981 | Tobioka et al. | 75/238 |
| 4,279,651 | 7/1981 | Fujimori et al. | 75/237 |
| 4,343,651 | 8/1982 | Yazu et al. | 75/238 |
| 4,497,874 | 2/1985 | Hale | 428/551 |
| 4,610,931 | 9/1986 | Nemeth | 428/547 |
| 4,693,989 | 9/1987 | Sane | 75/238 |
| 4,828,612 | 5/1989 | Yohe | 75/238 |

FOREIGN PATENT DOCUMENTS

| | | | |
|---|---|---|---|
| 54-116343 | 9/1979 | Japan | 428/564 |
| 57-41345 | 3/1982 | Japan | 75/238 |
| 57-47844 | 3/1982 | Japan | 75/238 |
| 59-41445 | 3/1984 | Japan | 75/238 |

*Primary Examiner*—Stephen J. Lechert, Jr.
*Assistant Examiner*—Nina Bhat
*Attorney, Agent, or Firm*—Robert E. Walter

[57] ABSTRACT

A cemented carbide cutting tool substrate has enhanced surface toughness due to binder enrichment and depletion of aluminum nitride near the peripheral surface.

1 Claim, No Drawings

SURFACE MODIFIED CEMENTED CARBIDES

This is a continuation of copending application Ser. No. 129,565, filed Dec. 7, 1987, now U.S. Pat. No. 4,828,612.

FIELD OF INVENTION

The present invention is directed to cemented carbide bodies having the surface modified for improved toughness.

BACKGROUND OF INVENTION

Cemented carbide parts with cobalt, nickel, iron, or their alloys as binder material often have hard refractory coatings applied to their surfaces for improving the wear resistance of the cutting edge. Although the surface coatings are very wear resistant, they are very brittle in comparison to the sintered cemented carbide substrate and may crack during cutting. The prior art has concentrated on improving toughness or edge strength in coated cutting inserts by forming a binder enrichment of the surface to promote improved toughness and reduce the susceptibility of the cutting edge to fail by chipping or breakage.

U.S. Pat. No. 4,277,283 to Tobioka et al relates to a process cutting insert having enriched binder content at the surface and a reduced surface content of carbides having a B-1 type crystal structure.. Other U.S. patents relating to enriched binder content at the surface include U.S. Pat. Nos. 4,610,931 to Nemeth et al; 4,548,786 to Yohe; and 4,497,874 to Hale et al. An extensive prior art summary is provided in the Hale patent.

Heretofore, the prior art has concentrated on adding titanium nitride or titanium carbonitride to aid the decomposition of the B-1 carbides near the surface during sintering and form a composition having an enriched binder content.

SUMMARY OF THE INVENTION

The present invention provides for a new ingredient to cemented tungsten carbide not hereinbefore known to provide binder enrichment. It is an object of the present invention to provide for binder enrichment without the presence of B-1 phases in the substrate material. If B-1 phases are present, it is an object of the present invention to provide depletion of B-1 phases near the surface of a cemented carbide without titanium nitride or titanium carbonitride additions.

In accordance with the present invention, the cemented carbide body comprises at least about 70 percent by weight tungsten carbide, a metallic binder, and aluminum nitride in an amount sufficient to enhance the surface toughness of the cemented carbide body by promoting binder enrichment and depletion of aluminum nitride near a peripheral surface. Cutting tools of the above carbide bodies are provided with a hard refractory coating.

Aluminum nitride has been utilized in refractory metal compositions but not as an agent for promoting binder enrichment of the surface. The following U.S. Patents are directed to aluminum nitrides 3,507,631; 3,409,416; 3,669,695; 3,409,419; and 3,507,631.

DETAILED DESCRIPTION

The cemented transition metal carbide substrate comprises metal carbide particles in an amount from about 70 to about 97 percent by weight dispersed throughout a matrix of binder material which is present in an amount from about 3 to about 30 Percent by weight. Typical transition metal carbides are carbides of tungsten, molybdenum, chromium, columbium, tantalum, titanium, zirconium, vanadium and hafnium. The cemented carbide cutting inserts of the present invention are preferably tungsten carbide based. Tungsten carbide is preferably employed in an amount greater than about 70 percent by weight. Due to its excellent wetability with binders, tungsten carbide is preferably used in its hexagonal form. Additional carbides having B-1 structure are typically added or mixed with the tungsten carbide to impart improved crater resistance to the substrate. The most common additional carbides are those of titanium and tantalum with some specialized use made of the carbides of columbium, molybdenum, vanadium, chromium, zirconium and hafnium. Preferably less than about 15 percent by weight of the cemented carbide comprises such additional carbides. A principle purpose of including additional carbides with tungsten carbide is to improve crater resistance of the substrate.

The matrix metal binder material employed for the substrate is preferably the iron group metals comprising cobalt nickel and iron. Cobalt is the most preferred. Cobalt is preferred for use for tungsten carbide due to its excellent wetability. Other materials may be alloyed with the metal binder materials provided the desirable final properties are not effected.

Small amounts of alloying agents may be added to the iron group metals. Typical alloying agents are molybdenum, tungsten, rhenium. The amount of alloying agent is preferably less than about 10 percent of the total weight of the matrix metal binder material.

In accordance with the principles of the present invention, the cemented carbide substrate comprises aluminum nitride as an additional ingredient. Near the peripheral surface, the aluminum nitride is at least partially depleted, but the binder is enriched. Hence, the resulting substrate has a toughened surface which is available for receiving hard refractory coating. Preferably, the binder enrichment is about 1.2 times the average concentration in the substrate. More preferably, about 1.4 times the concentration.

Aluminum nitride is present in an amount from an effective amount resulting in binder enrichment to about 20 percent by weight. At higher concentrations of aluminum nitride, the desirable favorable toughness property of tungsten carbide based alloys may be unfavorably altered. Most preferable, the amount of aluminum nitride is at an amount less than about 10 percent by weight based on the total weight of the cutting insert. Even more preferably, the amount of aluminum nitride is less than 5 percent by weight.

A preferred composition of the present invention includes additions of B-1 hard phase carbides. These carbides have a face centered cubic structure and include carbides of tantalum, titanium, vanadium, niobium and tantalum. Preferably, additions of B-1 hard phase carbides are in an amount less than about five percent by weight. Titanium carbide and tantalum carbide are preferred B-1 hard phase carbides. During the sintering step as carried out in the present invention, the B-1 hard phase carbides become depleted near the peripheral surface. It is believed that the depletion of both aluminum nitride and hard phase carbides results in an improved binder enrichment.

The binder enrichment and aluminum nitride depletion near the surface is obtained by decomposition of aluminum nitride during heating. According to one embodiment of the invention, both aluminum nitride and B-1 hard phase carbides are decomposed. The aluminum nitride and additional carbides are incorporated into the cemented carbide powder during the preparation of the grade powders. Grade powders are intimate mixtures of refractory metal carbide powders plus the metallic binder. Grain inhibitors and additional ingredients including the aluminum nitride are conveniently blended to form a blended powder mixture. Generally, the grade powders include an organic binder which also serves as a pressing lubricant.

Typically sintered metal carbide bodies are prepared by pressing the grade powder in hard steel or carbide lined steel molds at pressures usually ranging from 5 to 30 tons per square inch depending on the size and shape of the compact. Sintering is then performed under conditions which cause a decomposition of the aluminum nitride near the surface. Preferably, sintering is performed under vacuum conditions. The temperature of sintering is generally from about 1350° to 1500° C. for times of about 30 to 150 minutes. Longer times can be utilized but are generally uneconomical.

The preferred cutting inserts of the present invention are coated with at least one hard adherent coating layer comprising a refractory material. Typical refractory material for the adherent coating layers include nitride, carbides and carbonitrides of titanium, vanadium, chromium, zirconium, niobium, molybdenum, hafnium, tantalum and tungsten. Aluminum oxide and zirconium oxide are preferred oxide coatings. The preferred are titanium nitride, titanium carbide, titanium carbonitride, hafnium nitride, hafnium carbide and hafnium carbonitride and alumina. The above coatings are preferably applied by methods known in the art such as chemical vapor deposition techniques.

The composite substrate body produced by the methods of the examples given above are coated with a refractory material by chemical vapor deposition techniques or physical vapor deposition techniques known in the art. For example, the preferred intermediate coatings of titanium nitride, titanium carbide, titanium carbonitride, hafnium nitride, hafnium carbide or hafnium carbonitride and alumina are applied by chemical vapor deposition. Other refractory materials are applied by chemical vapor deposition techniques where such techniques are applicable, or by physical vapor deposition techniques such as direct evaporation, sputtering, etc.

Useful characteristics of the chemical vapor deposition method are the purity of the deposited layer and the tendency for some diffusional interaction between the layer being deposited and the substrate during early stages of the deposition process which leads to good layer adherently.

As an example, titanium nitride intermediate coating layers and outer coating layers are formed on the modified composite substrate or on the intermediate coating layers of cutting tools of this invention by passing a gaseous mixture of titanium tetrachloride, a gaseous nitrogen source such as nitrogen or ammonia, and hydrogen over the substrate at a temperature of between about 800° C. and 1500° C., preferably at temperatures above about 1000° C. The reaction is described by the following equation; hydrogen is added to insure that the reaction takes place in a reducing environment;

$$2TiCl_4+N_2+4H_2=2TiN+8HCl$$

As another example, titanium carbide intermediate coating layers or outer coating layers are formed on the modified composite substrates or on the intermediate coating layers of cutting tools of this invention by passing a gaseous mixture of titanium tetrachloride, a gaseous carbon source such as methane, and hydrogen over the substrate at a temperature of between about 800° C. and 1500° C., preferably at temperatures above about 1000° C. The reaction is described by the following equation, although hydrogen is often added to insure that the reaction takes place in a reducing environment:

$$TiCl_4+CH_4=TiC+4HCl$$

As another example, titanium carbonitride intermediate coating layers or outer coating layers are formed on the composite or intermediate coating layers of cutting tools of this invention by the chemical vapor deposition technique of passing a gaseous mixture of titanium tetrachloride, a gaseous carbon source such as methane, a gaseous nitrogen source such as nitrogen or ammonia, and hydrogen over the substrate at a temperature of between about 800° C. and 1500° C. preferably at temperatures above about 1200° C. Dissociated ammonia may be substituted for a mixture of nitrogen and hydrogen gases. The reaction is described by the following equation, although hydrogen is often added to insure that the reaction takes place in a reducing environment:

$$TiCl_4+CH_4+N_2=Ti(C_xN_y)+4HCl$$

The mixture is passed over the heated substrate until the desired coating thickness is achieved. Routine experimentation is used to determine the rate of coating thickness growth at a particular gaseous flow rate and temperature.

Control of the amounts of methane and nitrogen in the gas mixture permit the formation of layers in which the ratio of x to y in the formula ($Ti(C_xN_y)$) are varied. The preferred values of x and y range between about 0.5 to about 0.6 for x and from about 0.4 to about 0.5 for y resulting in a preferred range of x/y ratio of from about 1.0 to about 1.5. The most preferred ratio of x to y is about 1.22, corresponding to values for x and y of about 0.55 and about 0.45, respectively.

As another example, alumina intermediate coating layers or outer coating layers are formed on the composite or intermediate coating layers of the cutting tools of this invention by chemical vapor deposition techniques or physical vapor deposition techniques or physical vapor deposition techniques known in the art. In one chemical vapor deposition technique, more fully described in U.S. Pat. No. 3,914,473, vaporized aluminum chloride or other halide of aluminum is passed over the heated coated substrate together with water vapor and hydrogen gas. Alternatively, the aluminum oxide is deposited by physical vapor deposition techniques such as direct evaporation or sputtering. The reaction for the chemical vapor deposition technique is described by the following equation, although hydrogen gas is often added to insure that the reaction takes place in a reducing atmosphere:

$$2AlCl_3+3H_2O=Al_2O_3+6HCl$$

The substrate or coated substrate piece or pieces are heated to a temperature between about 800° C. to about 1500° C. in a furnace equipped for gaseous flow. The aluminum chloride supply is preheated to vaporize the material, and the aluminum chloride vapor is passed through the furnace, together with the other gases. The gas mixture is passed over the heated substrate or coated substrate until the desired coating thickness is achieved. Routine experimentation is used to determine the rate of coating thickness growth at a particular gaseous flow rate and temperature.

In another, preferred method of coating the composite substrate bodies or the intermediate coatings with one or more adherent alumina coating layers, aluminum chloride is reacted with carbon dioxide in the presence of hydrogen gas according to the following equation:

$$2AlCl_3+3CO_2+3H_2=Al_2O_3+3CO+6HCl;$$

carbon monoxide is optionally added to the gas mixture passed over the heated substrate or coated substrate bodies in order to establish the desired equilibrium gas composition.

Depending on the machining application and the work piece material, the combination of various coatings as described above can be tailored to enhance the overall tool performance. This is achieved through the combinations which lead to improved adherence of the coatings to substrate and the coatings to coatings, and achieved by the improved structure/property of the coatings such as hardness, fracture toughness, impact resistance, chemical inertness, etc.

EXAMPLE 1

A grade powder mix containing 89.7 percent tungsten carbide, 4 percent aluminum nitride, and 6 percent cobalt is charged to a ball mill and blended. The total powder charge weight is 1 kilogram. The ball weights are 6.2 kilogram. The charge is milled at 85 RPM in a 4 inch diameter ball mill for 24 hours in heptane as a milling liquid. The milled charge is then air dried and screened. Inserts of one-half inch square are prepared by pressing the green powder at 15 tons per square inch. The resulting pressed squares are vacuum degassed at 1200° C. for 150 minutes followed by sintering at 1440° C. for 100 minutes in 1 torr pressure of argon to reduce cobalt evaporation. The resulting insert is sectioned and mounted. The microstructure near the surface is observed by examination of a micrograph at 1500×. A black phase is identified on the photomicrograph as aluminum nitride. A light grey phase is tungsten carbide and a white phase is cobalt. The aluminum nitride is depleted to a depth of about 15 microns below the surface. The white phase is observed as having an increased concentration near the surface. This concentration approaches 1.2 times the core cobalt concentration.

EXAMPLE 2

A powder mix is prepared according to the technique set forth in Example 1. The charge contained 75 percent by weight, tungsten carbide having a 5 micron particle size (FSSS), 6 percent by weight WTiC, 5 percent TaC, 4.0 percent AlN, 7.0% Co and 0.28%C. Powder is pressed in a manner according to Example 1. The one-half inch square parts were placed on a Dylon E818 coated graphite shelf and vacuum sintered as set forth in Example 1. In addition to the phases observed in Example 1, a dark grey phase was identified as a B-1 cubic carbide or carbonitride phase. This phase is depleted to a depth of about 10 to 14 microns below the surface. This depletion is in addition to the depletion of the aluminum nitride phase as described in Example 1. A similar cobalt enrichment adjacent the surface is observed which approaches 2.4 times the core cobalt content.

EXAMPLE 3 A lower AlN content composition containing 82 percent WC, 6 percent WTiC, 4.0 percent TaC, 1.0 percent AlN, 7.0 percent Co, 0.07 percent C was prepared and sintered as described in Example 2. The resultant composition has a 16 micron deep B-1 phase depleted layer and a 40 to 50 micron deep AlN depleted layer. A profile of the cobalt content of the surface layer was analyzed using x-ray wavelength dispersion spectroscopy (WDS) on the SEM at 5 micron depth intervals at four locations with the results set forth in Table 1. An analysis of another sample, 1.8 percent aluminum was found in the beta-free layer where AlN is depleted. Thus, indicating that some aluminum may remain in the binder phase.

TABLE 1

| | PERCENT COBALT | | | | |
|---|---|---|---|---|---|
| DEPTH | TOP (1) | TOP (2) | BOTTOM (3) | BOTTOM (4) | AVG. |
| 0–5 | 9.5 | 9.3 | 9.9 | 9.7 | 9.6 ± 0.25 |
| 5–10 | 10.2 | 11.3 | 12.2 | 13.3 | 11.8 ± 1.3 |
| 10–15 | 9.3 | 11.4 | 13.3 | 12.8 | 11.7 ± 1.8 |
| 15–20 | 7.5 | 7.3 | 8.9 | 10.2 | 8.5 ± 1.4 |
| 20–25 | 6.4 | 6.2 | 5.4 | 6.8 | 6.2 ± 0.6 |
| 25–30 | 5.0 | 6.6 | 5.9 | 5.6 | 5.8 ± 0.7 |
| 30–35 | 6.4 | 6.4 | 5.0 | 5.7 | 5.9 ± 0.7 |
| CORE | 7.1 | 7.2 | 7.3 | | |

AVERAGE % Co IN B-1 FREE LAYER = 10.4 ± 1.1%
AVERAGE PEAK % Co = 12.0 ± 1.5%

EXAMPLE 4

The cutting tools as prepared as in Examples 1 and 2 are coated with titanium carbide at atmospheric pressure. A gaseous mixture of about 1% $TiCl_4$, 2% $CH_4$, and 97% $H_2$ is passed over the substrate bodies at a flow rate of about 20 liters/minute in a chamber held at a temperature of about 1100° C. for a period of about 2 hours. The resulting coated substrate bodies had a uniform adherent coating of titanium carbide approximately 6 microns in thickness.

EXAMPLE 5

The cutting tools prepared as in Examples 1 and 2 are coated with a titanium carbonitride. A gaseous mixture of about 1%$TiCl_4$, 3.5% $CH_4$, 2.5% $N_2$ and 93% $H_2$ is passed over the cutting tools at atmospheric pressure and at a flow rate of about 20 liters/minute for a period of about 2 hours. The reactor was heated to a temperature of abut 1060° C. At the end of the coating period, the thickness was about 8 microns.

I claim:

1. A process for forming a binder enriched layer near a peripheral surface of a cemented carbide body having a peripheral surface formed by sintering a blended powder mixture.

said process comprising forming a homogeneous mixture of powders comprising at least 70 weight percent tungsten carbide in hexagonal form and a sufficient amount of additional carbides for improving crater resistance, said additional carbides having a B-1 structure and selected from the group consisting of the carbides of titanium, tantalum, columbium, molybenum, vanadium, chromium, zirconium and hafnium and being less than 15 percent by weight additional carbides, a cobalt metal binder material, and an effective amount of aluminum nitride in an amount sufficient for enhancing the surface toughness of the cemented carbide body by promoting binder enrichment and depletion of aluminum nitride and said additional carbides near a peripheral surface, sintering said powder mixture under conditions resulting in the decomposition of at least a portion of said aluminum nitride near said peripheral surface of said body during formation thereof whereby binder enrichment and depletion of aluminum nitride results, said binder enrichment comprising an increased cobalt metallic binder content near said peripheral surface of at least 1.2 times the average concentration of cobalt metallic binder in said substrate, said depletion of aluminum nitride and said additional carbides near a peripheral surface comprising substantially entirely depleting said aluminum nitride and said additional carbides near said peripheral surface while said average concentration of aluminum nitride and said additional carbides is retained in a remaining portion of said substrate.

* * * * *